US007182449B2

(12) United States Patent
Inoue

(10) Patent No.: US 7,182,449 B2
(45) Date of Patent: Feb. 27, 2007

(54) INKJET RECORDING APPARATUS

(75) Inventor: Hiroshi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/037,264

(22) Filed: Jan. 19, 2005

(65) Prior Publication Data

US 2005/0157130 A1 Jul. 21, 2005

(30) Foreign Application Priority Data

Jan. 21, 2004 (JP) ..... 2004-013246

(51) Int. Cl.
*B41J 2/175* (2006.01)

(52) U.S. Cl. ..... 347/93; 347/85

(58) Field of Classification Search ..... 347/7, 347/85, 86, 87, 92, 93
See application file for complete search history.

(56) References Cited

U.S. PATENT DOCUMENTS 4,007,684 A * 2/1977 Takano et al. ..... 101/366
4,301,459 A * 11/1981 Isayama et al. ..... 347/19
4,346,388 A * 8/1982 Wiley ..... 347/6
4,386,478 A * 6/1983 Belokin ..... 43/135
4,558,326 A * 12/1985 Kimura et al. ..... 347/30
6,517,189 B2 * 2/2003 Ogawa et al. ..... 347/35

FOREIGN PATENT DOCUMENTS

JP 01306257 * 11/1989 ..... 347/92
JP 2-95863 A 4/1990
JP 7-125246 A 5/1995
JP 10-34899 A 2/1998
JP 2001-18414 A 1/2001
JP 2001-18419 A 1/2001

* cited by examiner

*Primary Examiner*—Anh T. N. Vo
(74) *Attorney, Agent, or Firm*—Birch, Stewart, Kolasch & Birch, LLP

(57) ABSTRACT

An inkjet recording apparatus has an ink discharge head that discharges droplets of ink supplied from an ink tank via an ink supply channel. The apparatus includes a filter unit including a filter which removes foreign matters, the filter unit being arranged in the ink supply channel; a filter front chamber with a variable capacity formed upstream from the filter in the filter unit; an air bubble trap region which accumulates air bubbles formed in the ink, the air bubble trap region being formed at top of the filter front chamber; and a control device which controls the variable capacity of the filter front chamber.

15 Claims, 12 Drawing Sheets

INKJET RECORDING APPARATUS

BACKGROUND OF THE INVENTION

1. Field of the Invention

The present invention relates to an inkjet recording apparatus for forming images by discharging ink as ink droplets from an inkjet recording head (ink discharge head) onto a recording medium, and more specifically to an inkjet recording apparatus which can prevent air bubbles that have accumulated upstream of a filter from flowing into the ink discharge head by disposing the filter for removing foreign matters in an ink supply channel between an ink tank and an ink discharge head.

2. Description of the Related Art

Conventionally, one known example of an image recording apparatus is an inkjet recording apparatus (inkjet printer) that has an inkjet head (ink discharge head) with an alignment of multiple nozzles, and that forms an image on a recording medium by discharging ink from the nozzles while moving the inkjet recording head and the recording medium relatively to each other.

Various methods for discharging ink in inkjet printers are conventionally known. One known example is a piezoelectric system, wherein the volume of a pressure chamber (ink chamber) is changed by deforming a vibration plate that constitute part of the pressure chamber due to the deformation of a piezoelectric element (piezoelectric ceramic) so that the ink supply and the ink discharge to the pressure chamber are controlled. The other known example is a thermal inkjet system wherein ink is discharged by the expansion energy of the air bubbles created by heating ink.

According to an image recording apparatus that has an ink discharge head, such as an inkjet printer, ink is supplied from an ink tank that accumulates ink to an ink discharge head via an ink supply channel, and the ink is discharged from the ink discharge head by the discharge methods described above. However, air bubbles might form in the ink when the ink is supplied from the ink tank to the ink discharge head. When the air bubbles form in the ink, the air bubbles flow into the ink discharge head, so that the recorded image is missed due to a decrease of ink concentration and a failed discharge. Therefore, there is a problem according to degrade the quality of the recorded image.

In order to resolve the above problem, a known example of the inkjet recording apparatus conventionally comprises a filter member for removing foreign matters disposed in an ink supply channel which connects an ink cartridge and a recording head, and opposing surfaces of the filter member include the deforming members capable of displacement toward the filter member. Therefore, when the surfaces are pressed and deformed by an operating member, the air bubbles remaining upstream of the filter member are discharged downstream of the filter member due to a strong ink flow created by reducing the effective area of the filter member (for example, see Japanese Patent Application Publication No. 2001-18414).

Similarly, another known example comprises a deforming member which deforms toward a filter member by providing negative pressure in vicinity of the filter member in an ink supply channel between an ink cartridge and a recording head (for example, directly upstream of the filter member). Therefore, since the deforming member is deformed to close off the space upstream of the filter member in which the remaining air bubbles are apt to accumulate, the remaining air bubbles are forcefully pushed downstream of the filter member and discharged (for example, see Japanese Patent Application Publication No. 2001-18419).

However, according to Japanese Patent Application Publication No. 2001-18414, since the filter member cannot be deformed largely, the effective sectional area of the filter member cannot be reduced by much. In order to increase the amount of deformation, the filter sectional area must be increased, but the ink speed passing through the filter member is reduced by increasing the filter sectional area. Therefore, there is a problem that air bubbles cannot be discharged by passing through the filter member along with the ink.

In addition, according to Japanese Patent Application Publication No. 2001-18419, the deforming member is deformed by negative pressure. Eventually, while the surface of the recording head on which nozzles are formed is sealed by a capping device, the negative pressure is utilized during the ink suction by a suction pump to prevent nozzle clogging due to the solidifying of ink. Therefore, there is a problem in which the air bubbles cannot be removed with arbitrary timing.

SUMMARY OF THE INVENTION

The present invention has been contrived in view of such circumstances, and an object thereof is to provide an inkjet recording apparatus, which is designed such that air bubbles accumulating upstream of a filter provided in an ink supply channel between an ink tank and an ink discharge head are prevented from flowing into the ink discharge head.

In order to attain the aforementioned object, the present invention is directed to an inkjet recording apparatus having an ink discharge head that discharges droplets of ink supplied from an ink tank via an ink supply channel, the apparatus comprising: a filter unit including a filter which removes foreign matters, the filter unit being arranged in the ink supply channel; a filter front chamber with a variable capacity formed upstream from the filter in the filter unit; an air bubble trap region which accumulates air bubbles formed in the ink, the air bubble trap region being formed at top of the filter front chamber; and a control device which controls the variable capacity of the filter front chamber.

According to the present invention, since the air bubble trap region in a part of the filter unit that can accumulate air bubbles can be increased in size, the frequency of maintenance for discharging the accumulated air bubbles can be reduced while air bubbles are effectively prevented from flowing in to the ink discharge head. Therefore, it is possible to improve the productivity of the inkjet recording apparatus.

Preferably, the control device performs control so as to increase the capacity of the filter front chamber to enlarge the air bubble trap region during printing, and so as to reduce the capacity of the filter front chamber during the air bubbles discharging. Thus, since the size of the air bubble trap region is decreased, it is possible to decrease the size of the pump that suctions out ink containing air bubbles. In addition, since the amount of ink discharged by this suction is reduced, it is possible to reduce the amount of wasted ink.

The inkjet recording apparatus is preferably designed so that during printing, the control device performs control that reduces the capacity of the filter front chamber in accordance with amount of discharged ink so as to pressurize the ink after increasing the capacity of the filter front chamber, so that ink supply to the ink discharge head and pressurization on the ink are assisted.

The inkjet recording apparatus further comprises: a pressure gauge which measures pressure of the ink in the ink discharge head or in vicinity of the ink discharge head, wherein: during printing, the control device performs control that reduces the capacity of the filter front chamber in accordance with pressure value measured by the pressure gauge to pressurize the ink after increasing the capacity of the filter front chamber, so that ink supply to the ink discharge head and pressurization on the ink are assisted.

According to the present invention, the filter unit is not limited to being used only for removing foreign matters and air bubbles in the ink, but also can be used as a pump to assist in supplying the ink to the ink discharge head and increasing the ink pressure. Therefore, it is possible to ensure an improvement in the refilling of ink to the ink discharge head and an improvement in the discharge properties of highly viscous ink.

Also, it is preferable that the air bubble trap region is formed in the filter front chamber by inserting an ink inlet tube which supplies the ink from the ink supply channel to the filter unit, up to interior of the filter front chamber. More specifically, since the inkjet recording apparatus has a configuration in which the ink inlet tube is inserted to inside the filter front chamber, it is possible to increase the capacity with which air bubbles can be trapped.

Preferably, the inkjet recording apparatus further comprises: an air bubble determination device which determines the air bubbles in the air bubble trap region, wherein the air bubbles are discharged when amount of the air bubbles in the air bubble trap region reaches maximum amount of the air bubbles accumulable in the air bubble trap region. Also, the air bubble determination device preferably determines whether the air bubbles remain in the air bubble trap region after the air bubbles are discharged.

Thus, since an air bubble determination device is included in the inkjet recording apparatus, air bubbles can reliably and effectively be accumulated and discharged.

As described above, according to the inkjet recording apparatus of the present invention, since the filter front chamber is formed with a variable capacity, the size of the air bubble trap region can be increased. Also, while air bubbles are effectively prevented from flowing into the ink discharge head, the frequency by which maintenance for discharging the accumulated air bubbles can be reduced. Therefore, it is possible to improve the productivity of the inkjet recording apparatus.

In the case where the air bubble trap region is reduced in size during air bubble removal, the amount of wasted ink that is suctioned out and discharged can be reduced while the pump that suctions out the ink can be reduced in size.

Furthermore, in the case in which the ink inlet tube is inserted to inside of the filter front chamber, it is possible to increase the capacity with which air bubbles can be trapped.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PRESENT INVENTION

Figure 1:
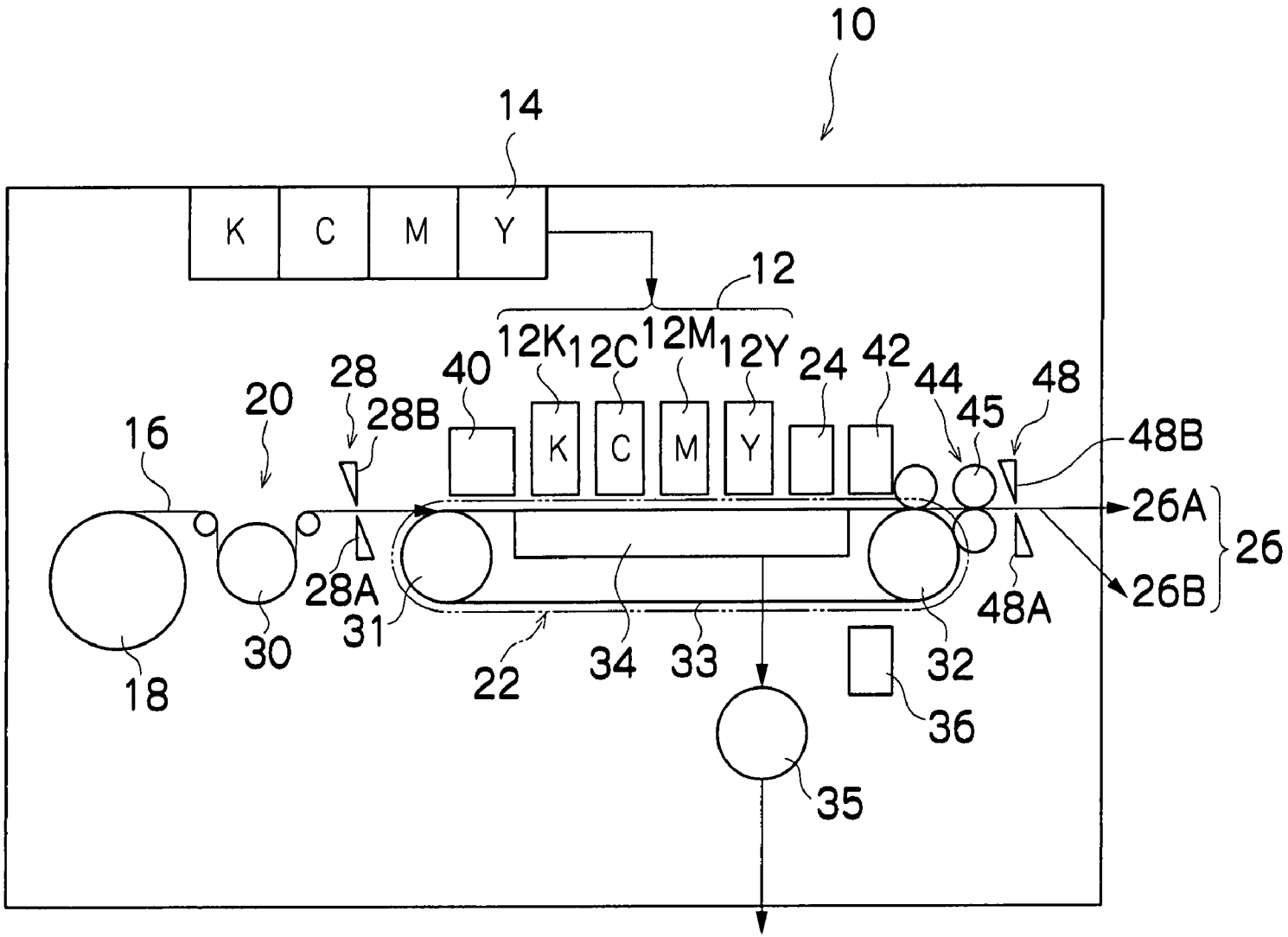
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads (ink-discharge heads) 12K, 12C, 12M, and 12Y for ink colors of black (K), cyan (C), magenta (M), and yellow (Y), respectively; an ink storing/loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet discharge face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 is driven in the clockwise direction in FIG. 1 by the motive force of a motor (not shown in FIG. 1) being transmitted to at least one of the rollers 31 and 32, which the belt 33 is set around, and the recording paper 16 held on the belt 33 is conveyed from left to right in FIG. 1.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16, which is substantially perpendicular to a width direction of the recording paper 16. Each of the print heads 12K, 12C, 12M, and 12Y is composed of a line head, in which a plurality of ink-droplet discharge apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side (left hand side in FIG. 1) along the delivering direction of the recording paper 16 (the paper conveyance direction). A color print can be formed on the recording paper 16 by discharging the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for discharging light-colored inks such as light cyan and light magenta are added.

As shown in FIG. 1, the ink storing/loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for discharge defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet discharge width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the discharge of each head is determined. The discharge determination includes the presence of the discharge, measurement of the dot size, and measurement of the dot deposition position.

A post-drying unit 42 is disposed following the print determination unit 24. The post-drying unit 42 is a device for drying the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device for controlling the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Although not shown in FIG. 1, a sorter for collecting prints according to print orders is provided to the paper output unit 26A for the target prints.

Figure 2:
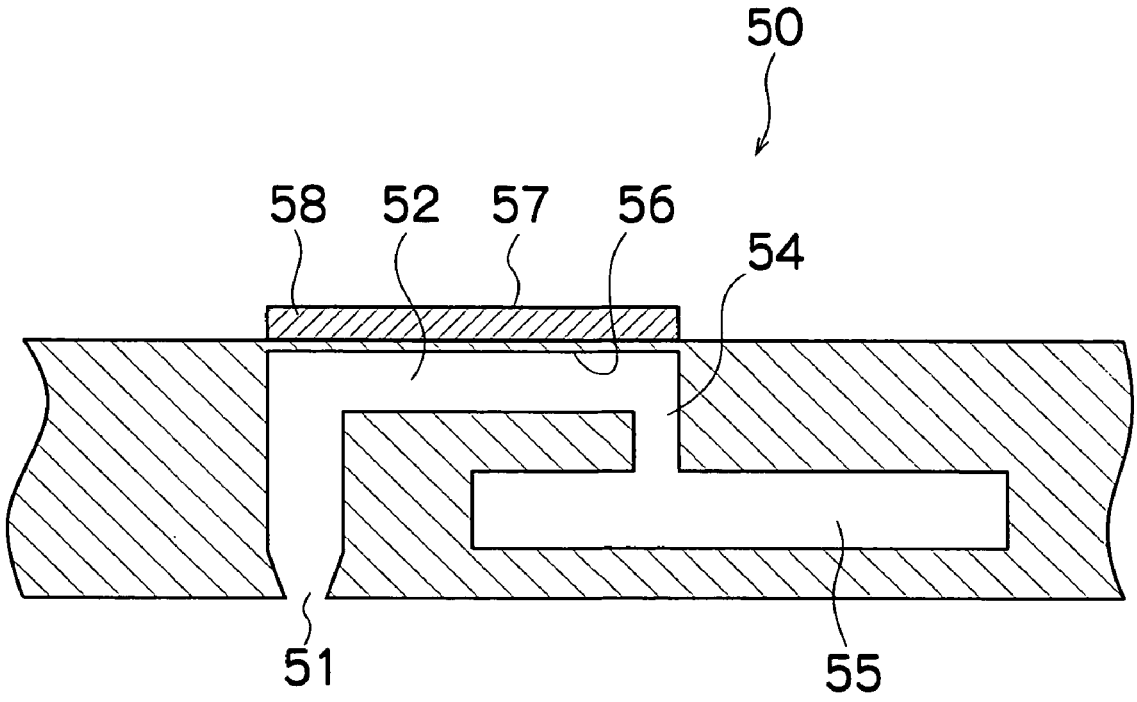
FIG. 2 is a principal cross-sectional view of a print head in the inkjet recording apparatus according to the embodiment.

Next, the structure of the print heads (liquid discharge heads) is described. The print heads 12K, 12C, 12M, and 12Y provided for the ink colors have the same structure, and reference numeral 50 is hereinafter designated to any of the print heads (liquid discharge heads) 12K, 12C, 12M, and 12Y. FIG. 2 is a perspective plan view showing an example of the configuration of the print head 50.

As shown in FIG. 2, the print head 50 in the present embodiment comprises: a nozzle 51 for discharging ink-droplets; and pressure chamber 52 connected to the nozzle 51 for giving pressure to discharge ink. The planar shape of the pressure chamber 52 provided for each nozzle 51 is substantially a square, and the nozzle 51 and (ink) supply port 54 are disposed in both corners on a diagonal line of the square. Each pressure chambers 52 are connected to a common channel 55 through a supply port 54.

A piezoelectric element (an actuator) 58 having a discrete electrode 57 is joined to a vibration plate (a pressure plate) 56, which forms a face of the pressure chamber 52 (the ceiling in FIG. 2). The piezoelectric element 58 is deformed by applying drive voltage to the discrete electrode 57, and the volume of the pressure chamber 52 is reduced so as to eject ink from the nozzle 51. When ink is discharged, the volume of the pressure chamber 52 is recovered, and then new ink is delivered from the common channel 55 through the supply port 54 to the pressure chamber 52.

Figure 3:
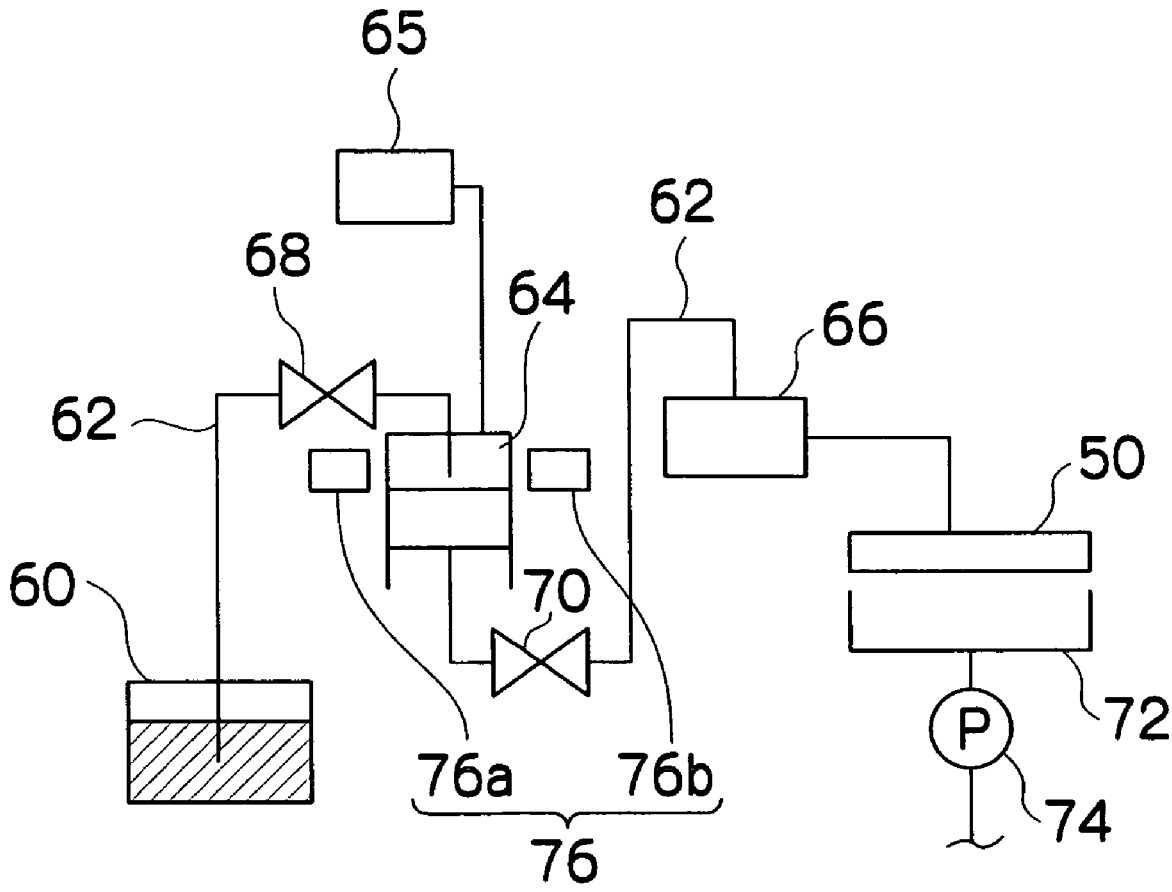
FIG. 3 is a schematic structural view of the ink supply system in the inkjet recording apparatus according to the embodiment.

FIG. 3 is a schematic drawing showing the configuration of the ink supply system in the inkjet recording apparatus 10. As shown in FIG. 3, an ink supply tank (ink tank) 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform discharge control in accordance with the ink type.

As shown in FIG. 3, an ink supply channel 62 that supplies ink from the ink supply tank 60 to the print head 50 comprises a filter unit 64 for removing foreign matters and air bubbles in the ink, as one of the characteristics according to the present invention. The configuration and operation of the filter unit 64 is described later.

The ink supply channel 62 between the filter unit 64 and the print head 50 includes a subtank 66. The subtank 66 has a damper effect to prevent internal pressure fluctuations in the print head 50 and a function to improve the refilling of ink. The sections of the ink supply channel 62 both upstream and downstream of the filter unit 64 are provided with the upstream and downstream valves 68 and 70 shown in FIG. 3, respectively.

The print head 50 is provided with a cap 72 as a device for preventing the nozzle 51 (referred in FIG. 2) from drying and for preventing the ink in vicinity of the nozzle from increasing in viscosity. Though not shown in FIG. 3, the print head 50 further comprises a cleaning blade for cleaning the nozzle surface in addition to the cap 72, so that a maintenance unit is formed in the print head 50. The maintenance unit including the cap 72 and the cleaning blade is movable relative to the print head 50 by a moving mechanism (not shown). The cap 72 and the cleaning blade are moved as necessary from a specific retracted position to a maintenance position underneath the print head 50 shown in FIG. 3.

The cap 72 is displaced up and down relative to the print head 50 by an elevator mechanism (not shown). When the power of the inkjet recording apparatus 10 is switched OFF or when in a print standby state, the cap 72 is raised to a predetermined moving position so as to come into close contact with the print head 50, and the nozzle surface is thereby covered with the cap 72. During printing or standby, when ink is not discharged for a specific time by reducing the frequency of using a specific nozzle 51, the ink solvent in vicinity of the nozzle evaporates and the viscosity of the ink increases. In this case, the ink cannot be discharged from the nozzle 51 even if the piezoelectric element 58 operates.

In order to resolve this problem, before such a state is realized, the piezoelectric element 58 is driven (within a range of viscosity by which discharge is possible by the operation of the piezoelectric element 58), the preliminary discharge (purge or expulsion) made toward the cap 72 as an ink receptor for discharging the deteriorated ink whose viscosity has increased in vicinity of the nozzle 51.

A suction pump 74 is connected to the cap 72, as shown in FIG. 3. When air bubbles are admixed into the print head 50, ink cannot be discharged from the nozzle 51 even if the piezoelectric element 58 is driven. In this case, after the cap 72 comes into close contact with the print head 50, the suction pump 74 removes by suctioning the ink in which the air bubbles have become intermixed. Thus, the recovered ink removed by suction is sent to a recovery tank (not shown). The above described suction operation is performed when the ink is initially filled into the print head 50, but the deteriorated ink that has increased in viscosity (hardened) is suctioned out when the inkjet recording apparatus 10 is first driven after being shut off for a long period of time. Incidentally, the amount of ink consumed is increased because the suction operation is performed on all the ink in the pressure chamber 52.

The filter unit 64 is also provided with an air bubble determination sensor 76 for determining air bubbles in an air bubble trap portion (i.e. the air bubbles trap region in which air bubbles are trapped) in the filter unit 64. The air bubble determination sensor 76 is configured with a light emitting element 76*a* and a light receiving element 76*b* which are disposed so as to face each other via the transparent section of the filter unit 64. Thus, the air bubble determination sensor 76 is designed to determine the air bubbles by changes of output voltage associated with the light receiving state of the light receiving element 76*b*.

Though a detailed explanation is described later, the filter unit 64 includes an air bubble trap region in which forms a filter front chamber with a variable capacity. The capacity variation of the filter front chamber is controlled with a control device 65 which has received the determination results from the air bubble determination sensor 76.

Figure 4A:
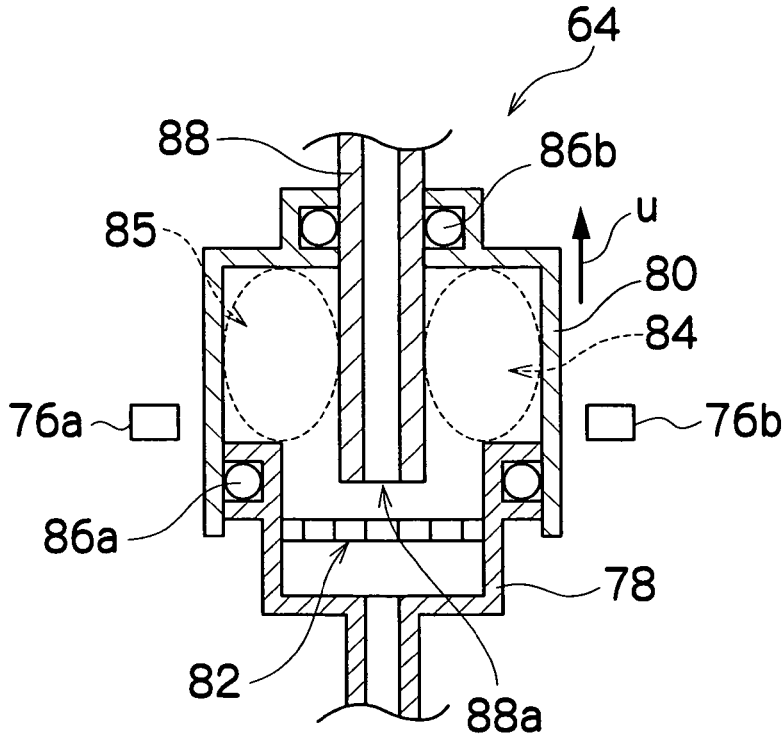
FIG. 4A is a schematic cross-sectional view showing an example of the filter unit in the embodiment when the capacity of the filter front chamber is increased.
Figure 4B:
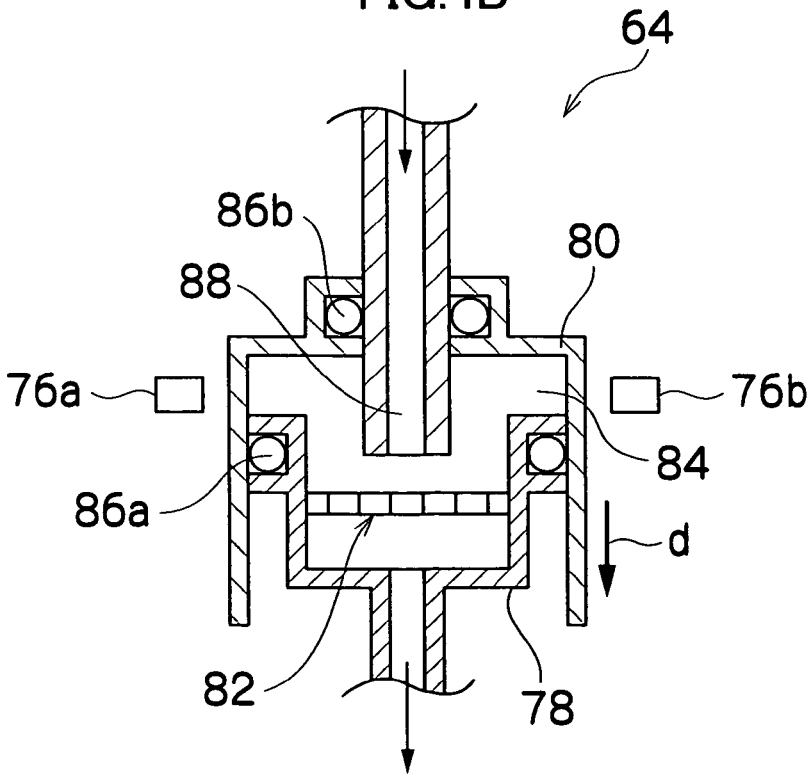
FIG. 4B is a schematic cross-sectional view showing an example of the filter unit in the embodiment when the capacity of the filter front chamber is reduced.

FIG. 4A is a schematic cross-sectional view showing an example of the filter unit 64 in the embodiment when the capacity of the filter front chamber is increased, and FIG. 4B is a schematic cross-sectional view showing an example of the filter unit in the embodiment when the capacity of the filter front chamber is reduced.

The filter unit 64 is configured from a fixed lower housing 78 and an upper housing 80 which is movable up and down. While the interior of the lower housing 78 is provided with a filter 82 for removing foreign matters and air bubbles in the ink, a section in the upper housing 80 on the top side partitioned off by the filter 82 forms a filter front chamber 84. The mesh size of the filter 82 is preferably equal to or less than the nozzle radius (generally about 20 μm).

The lower housing 78 and the upper housing 80 are provided with seal members 86*a* and 86*b*, respectively, to ensure confidentiality when the upper housing 80 moves. Also, an ink inlet tube 88 extends into the filter front chamber 84 from the ink supply channel 62 (see FIG. 3), and the top part of the filter front chamber 84 encompassing the ink inlet tube 88, which is shown by the dotted line in FIG. 4A, forms an air bubble trap region 85.

The upper housing 80 is not particularly limited in terms of the movement device thereof, but is capable of vertical movement, but the movement of the upper housing 80 is controlled by the control device 65 described above.

As shown by the arrow "u" in FIG. 4A, when the upper housing 80 moves upward, the capacity of the filter front chamber 84 is increased, and then the air bubble trap region 85 also increases in size. At this time, since the ink inlet tube 88 extends into the filter front chamber 84, the air bubbles trapped in the air bubble trap region 85 do not block off the ink supply port 88*a* of the ink inlet tube 88, and a sufficient amount of air bubbles can be trapped in the air bubble trap region 85. Therefore, the frequency with which air bubbles are discharged can be reduced and the productivity of the inkjet recording apparatus can be improved.

Furthermore, as described above, the filter unit 64 is provided with an air bubble determination sensor 76 (the light emitting element 76*a* and the light receiving element 76*b*) for determining air bubbles in the filter front chamber 84 (the air bubble trap region 85). At this time, since the light from the light emitting element 76*a* is to be determined by the light receiving element 76*b*, the portion of the filter unit 64 through which the determined light passes (including the ink inlet tube 88, depending on the situation) is necessarily formed from a transparent material.

When there are no air bubbles in the filter front chamber 84, the light from the light emitting element 76*a* is blocked by the ink in the filter front chamber 84 and is not determined by the light receiving element 76*b*. On the other hand, when air bubbles are present in the filter front chamber 84, the light from the light emitting element 76*a* passes through the air bubbles and reaches the light receiving element 76*b*. The voltage outputted by the light receiving element 76*b* therefore changes, and the air bubbles are determined by this change in voltage.

The air bubble determination sensor 76 (the light emitting element 76*a* and the light receiving element 76*b*) is fixed in place on the outer side of the filter unit 64 at a position where air bubbles at the lower end portion of the air bubble trap region 85 slightly above the end of the lower housing 78 can be determined.

As shown in FIG. 4A, when the upper housing 80 moves upward, the size of the filter front chamber 84 (i.e., the air bubble trap region 85) is increased. In this state, when the air bubbles at the lower end of the air bubble trap region 85 (i.e., the maximum amount of air bubbles that can be accumulated by the air bubble trap region 85) is determined by the air bubble determination sensor 76, the results of this determination are sent to the control device 65. The upper housing 80 is moved downward by the control device 65 (for example, printing is halted if this occurs during printing), and the capacity of the filter front chamber 84 decreases so as to discharge the air bubbles.

During discharging the air bubbles, first the upstream valve 68 of the filter unit 64 is closed, and the downstream valve 70 is opened (referred in FIG. 3). The upper housing 80 is moved downward by the control device 65 as shown by the arrow "d" in FIG. 4B, and the capacity of the filter front chamber 84 is decreased. Therefore, the air bubble trap region 85 also decreases in size. Next, while the upstream valve 68 is opened, the cap 72 comes into close contact with the print head 50. Then, the air bubbles are removed by suctioning out the ink downstream of the upstream valve 68 along with the bubbles by the suction pump 74, as shown by the arrow in FIG. 4B.

Since the ink is pressurized by closing the upstream valve 68 and reducing the capacity of the filter front chamber 84 at this time, it is possible to reduce the load on the suction pump 74. In addition, during discharging the air bubbles, the upper end of the air bubble trap region 85 is positioned at the air bubble determination sensor 76 as shown in FIG. 4B. Therefore, the air bubble determination sensor 76 can determine whether the air bubbles remain in the upper layer of the air bubble trap region 85 after discharging the air bubbles.

Figure 5A:
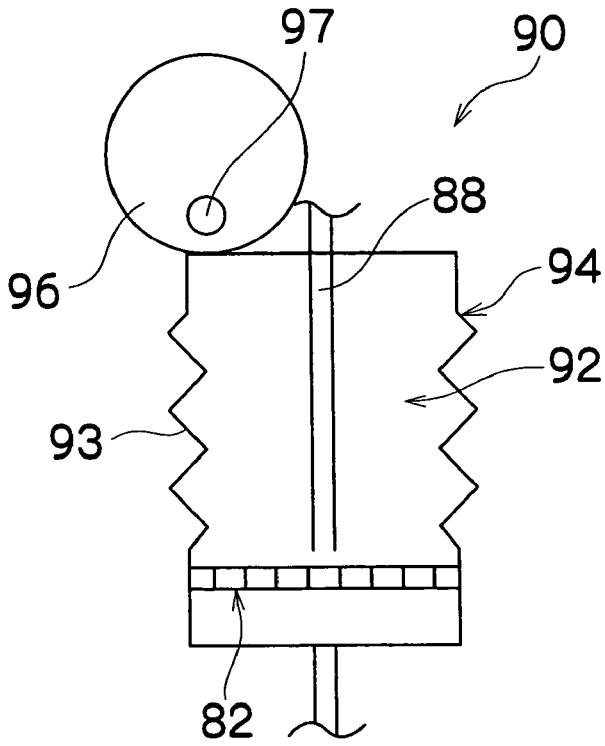
FIG. 5A is a cross-sectional view showing another example of a filter unit when the capacity of the filter front chamber is increased.
Figure 5B:
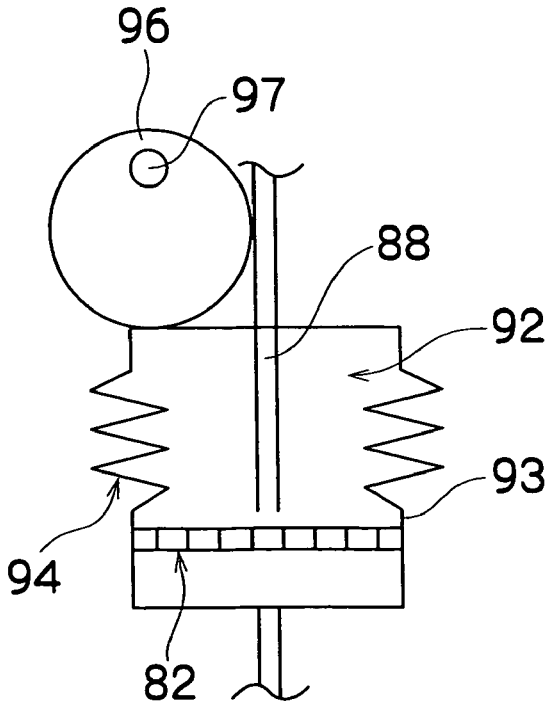
FIG. 5B is a cross-sectional view showing another example of a filter unit when the capacity of the filter front chamber is reduced.

The configuration of the filter unit 64 is not limited to a cylinder type such as the one shown in FIGS. 4A and 4B, and the filter front chamber 84 having a variable capacity may be adapted. For example, as shown in FIGS 5A and 5B, the filter unit 90 may have a structure, wherein a housing 93 above the filter 82 includes a bellows 94 and an upper edge of the housing 93 is pressed by an eccentric cam 96 so as to vary the capacity of a filter front chamber 92.

In this situation, the eccentric cam 96 rotates around a rotational shaft 97. When the lower side of the rotational shaft 97 becomes smaller as shown in FIG. 5A, the bellows 94 extends so as to increase the capacity of the filter front chamber 92. On the other hand, when the lower end of the rotational shaft 97 becomes larger as shown in FIG. 5B, the bellows 94 is shrunk so as to reduce the capacity of the filter front chamber 92.

Next, the operation of discharging the air bubbles and filling the ink is described in following as the characteristics of the present embodiment.

Figure 6:
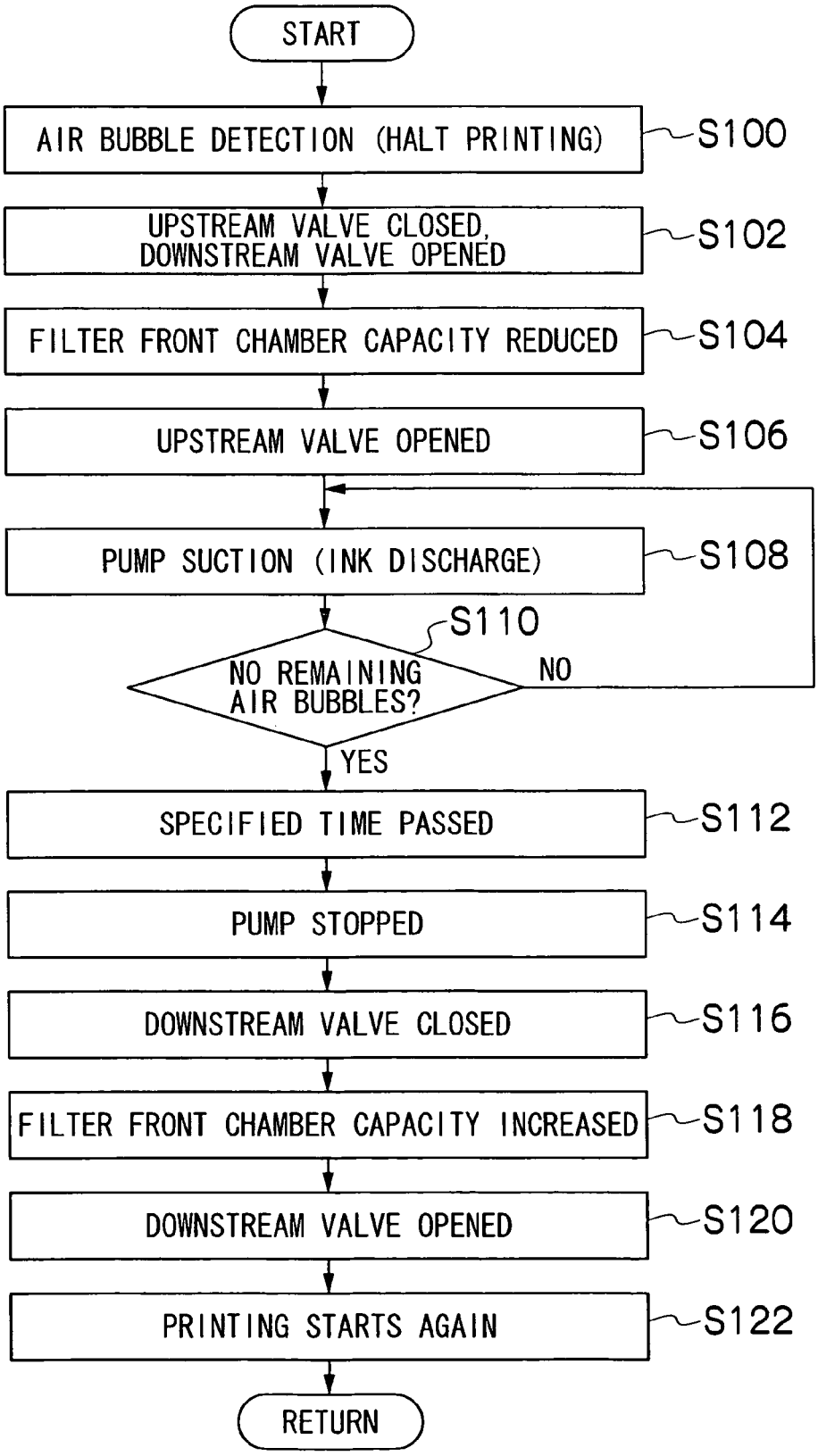
FIG. 6 is a flowchart showing the operation of discharging air bubbles in the present embodiment.

FIG. 6 is a flowchart showing the operation of discharging air bubbles in the present embodiment. As shown in FIG. 6, air bubbles are determined by the air bubble determination sensor 76 at step S100. During printing, since the filter front chamber 84 becomes larger so as to increase the size of the air bubble trap region 85 as shown in FIG. 4A, the region in which air bubbles can be trapped is maintained at a large size. The air bubbles trapped by the filter 82 are accumulated in the air bubble trap region 85 due to their buoyant force. At this time, since the ink inlet tube 88 is inserted to inside of the filter front chamber 84 as described above, the air bubbles do not block off the ink supply port 88*a* of the ink inlet tube 88. Therefore, it is possible to certainly increase the amount of air bubbles that can be trapped. When the air bubble determination sensor 76 determines that air bubbles have accumulated in the lower end of the air bubble trap region 85 (i.e., determines the maximum amount of air bubbles accumulable in the air bubble trap region 85), printing is halted if necessary and the air bubbles discharge operation proceeds.

At step S102, the upstream valve 68 of the filter unit 64 is closed and the downstream valve 70 is opened. Next, the upper housing 80 is moved downward (in the direction of compression) by the control device 65 to reduce the capacity of the filter front chamber 84 (step S104).

At step S106, the upstream valve 68 is opened, and the process proceeds to step S108. At step S108, the suction pump 74 is driven while the cap 72 comes into close connect with the print head 50, and the air bubbles accumulated in the air bubble trap region 85 of the filter front chamber 84 are suctioned out along with the ink. Next, when the process proceeds to step S110, the air bubble determination sensor 76 determines whether air bubbles remain in the filter front chamber 84. When air bubbles do still remain, the process returns to step S108 and the suction pump 74 again suctions out the air bubbles.

When no air bubbles are present, the process waits until a specified time has passed to the step S112. Then, at step S114, suction by the suction pump 74 is halted. Next, at step S116, the downstream valve 70 of the filter front chamber 84 is closed. Then, at step S118, the upper housing 80 is moved upward (in the direction of expansion) by the control device 65, and the capacity of the filter front chamber 84 is increased. At this time, the ink is led from the ink tank 60 to the filter unit 64 via the ink inlet tube 88, and the air bubble trap region 85 is maintained at a large size. Next, the downstream valve 70 of the filter unit 64 is opened at step S120, and printing restarts at step S122.

Thus, in the present embodiment, since the air bubble trap region 85 can be maintained at a large size, the amount of air bubbles that can be trapped is increased. Therefore, since the suction frequency for discharging air bubbles can be reduced, it is possible to improve the productivity of the inkjet recording apparatus 10. Furthermore, during discharging air bubbles, the air bubbles (air layer) can be passed through the filter 82 by applying a light suction force with the suction pump 74 without bringing the ceiling of the filter front chamber 84 and the filter 82 in contact with each other. Therefore, while the size of the suction pump 74 can be reduced, the amount of ink discharged with the air bubbles can also be reduced.

Figure 7:
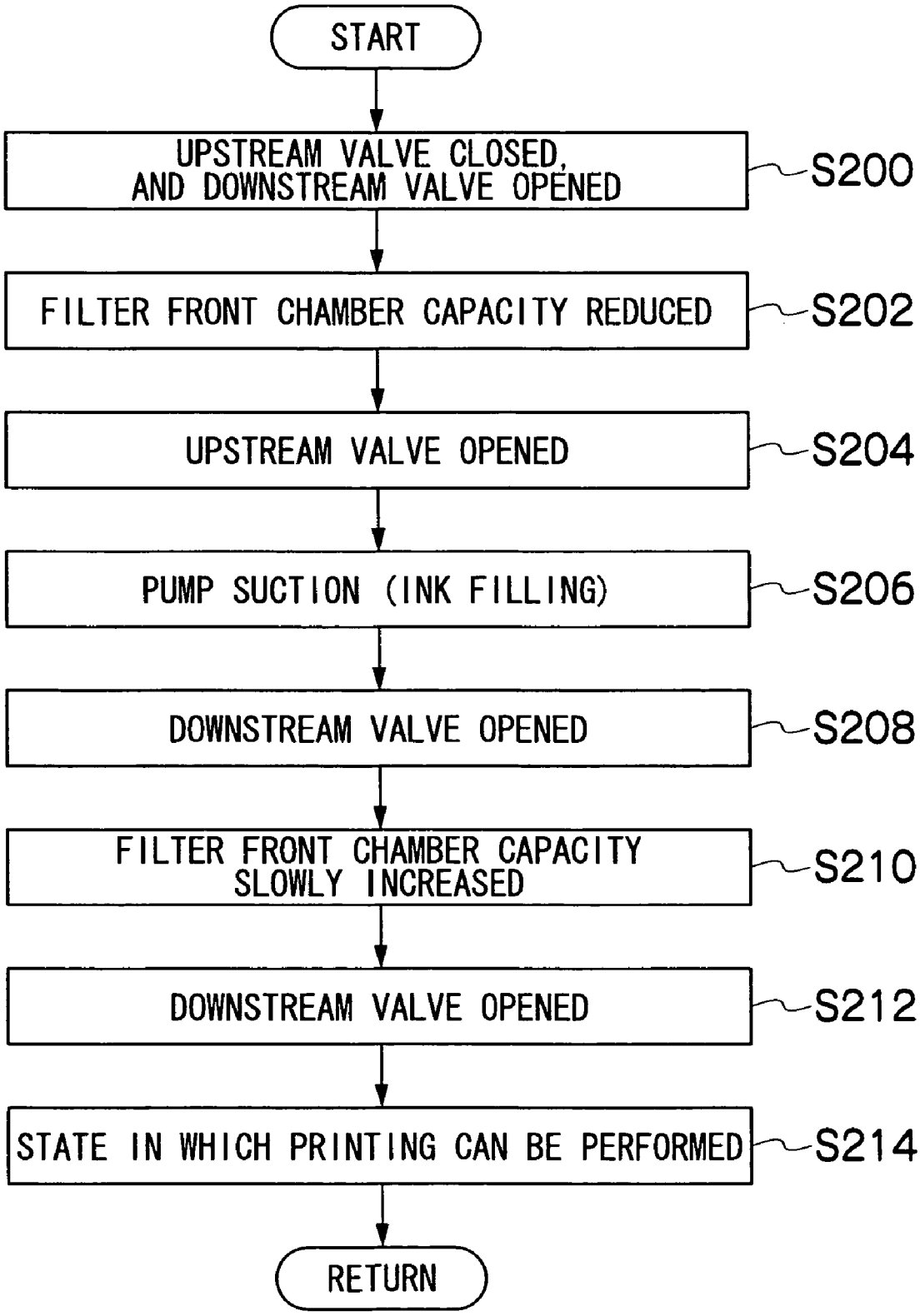
FIG. 7 is a flowchart showing the operation of ink filling in the embodiment.

Next, the operation of ink filling is described with reference in FIG. 7. FIG. 7 is a flowchart showing the operation of ink filling in the embodiment. First, the downstream valve 70 is opened while the upstream valve 68 of the filter unit 64 is closed (step S200). Next, the upper housing 80 is moved downward (in the direction of compression) to reduce the capacity of the filter front chamber 84 (step S202).

After the upstream valve 68 of the filter unit 64 is opened at step S204, the cap 72 comes into close contact with the print head 50 and the suction pump 74 is driven to fill the ink from the ink supply tank 60 into the print head 50 (step S206).

After the valve 70 downstream of the filter unit 64 is closed at step S208, the upper housing 80 is moved upward (in the direction of expansion) by the control device 65, the capacity of the filter front chamber 84 is increased (step S210). At this time, ink is filled into the filter unit 64 along with the capacity increase of the filter front chamber 84.

Then, the downstream valve 70 of the filter unit 64 is opened at step S212, and a state in which printing can be performed is achieved at step S214.

Next, an embodiment including another configuration of the ink supply system in the present invention is described. In this embodiment, the ink is pressurized by utilizing the pump action of the filter unit to improve the refilling of ink, and particularly to improve the discharge properties for highly viscous ink.

Figure 8:
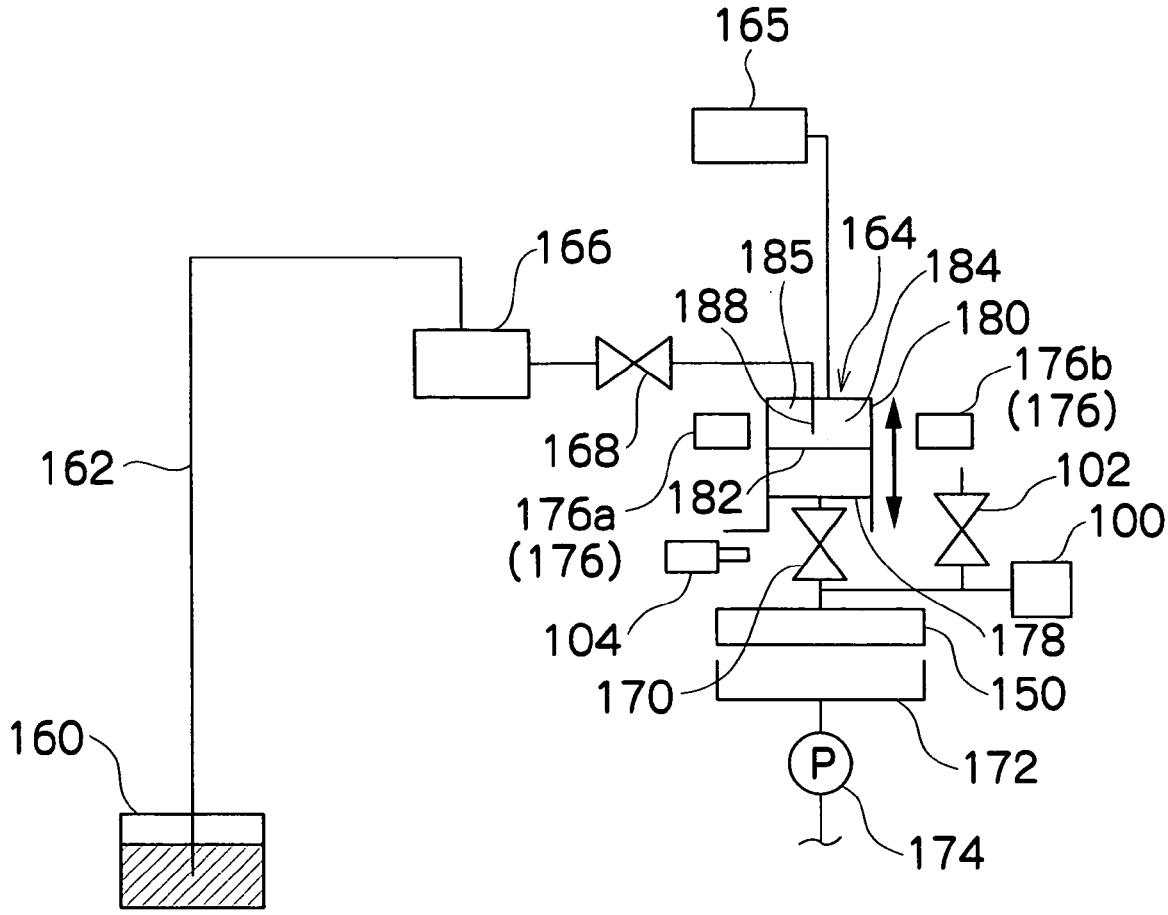
FIG. 8 is a schematic structural view of an ink supply system in an inkjet recording apparatus according to another embodiment of the present invention.

FIG. 8 is a schematic structural view of an ink supply system in an inkjet recording apparatus 10 according to another embodiment of the present invention. The ink supply system shown in FIG. 8 is different from the ink supply system shown in FIG. 3 because the filter unit is disposed in the vicinity directly above the print head to pressurize the ink. In addition, a pressure gauge and a position sensor are also provided for controlling the filter unit.

More specifically, as shown in FIG. 8, an ink tank 160 is a base tank for supplying ink to a print head 150. The ink tank 160 is equivalent to the ink storing/loading unit 14 in FIG. 1. An ink supply channel 162 that supplies ink from the ink tank 160 to the print head 150 is provided with a subtank 166, and a filter unit 164 is disposed between the subtank 166 and the print head 150. An upstream valve 168 is provided upstream of the filter unit 164 (between the filter unit 164 and the subtank 166), and a downstream valve 170 is provided downstream of the filter unit 164 (between the filter unit 164 and the print head 150).

The structure of the filter unit 164 is similar to the one shown in FIG. 4. The filter unit 164 comprises: a lower housing 178 which is fixed; an upper housing 180 which is capable of vertical movement; and a filter 182 for removing foreign matters and air bubbles in the ink. A filter front chamber 184 is formed in the upper housing 180 above the filter 182, and an ink inlet tube 188 is inserted into the filter front chamber 184. The upper portion of the filter front chamber 184 includes an air bubble trap region 185 for trapping air bubbles.

The print head 150 is provided with a cap 172 for preventing the nozzle (not shown) from drying, and is also provided with a suction pump 174 for suctioning out ink.

The filter unit 164 is provided with an air bubble determination sensor 176 for determining air bubbles in the filter front chamber 184 (the air bubble trap region 85), consisting of a light emitting element 176*a* and a light receiving element 176*b*.

In the another embodiment, a pressure gauge 100 for determining the ink pressure in the vicinity of the print head 150 is provided in addition to the configuration described above embodiment in FIG. 3. Also, an atmosphere opening valve 102 is provided immediately in vicinity of the pressure gauge 100. Furthermore, a position determination sensor 104 for determining the position of the movable upper housing 180 is provided in vicinity of the filter unit 164 to check the capacity of the filter front chamber 184. A control device 165 is provided in vicinity of the filter unit 164 to move the upper housing 180. The control device 165 controls the capacity variation of the filter front chamber 184 on the basis of the determination results of the air bubble determination sensor 176, the pressure gauge 100, and the position determination sensor 104.

Next, the operations of discharging ink and air bubbles is described as the characteristic of the another embodiment.

During standby mode, the inkjet recording apparatus remains in standby in a state in which the upper housing 180 is moved upward to increase the capacity of the filter front chamber 184 in same way as the embodiment shown in FIG. 4A. The operation of ink discharge is described with reference to in FIGS. 9 through 11.

Figure 9:
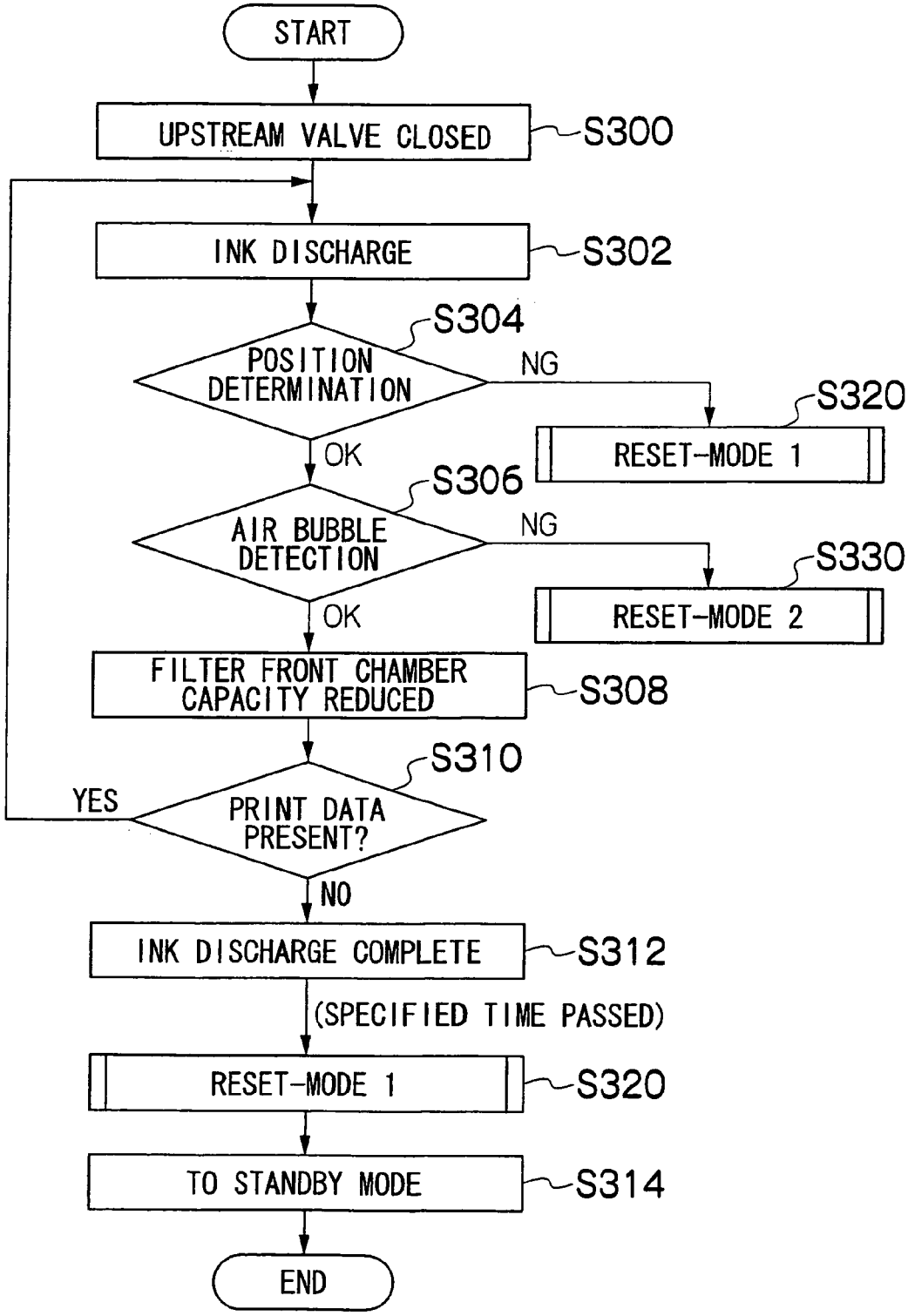
FIG. 9 is a flowchart showing the operation of ink discharge in the another embodiment.

As shown in FIG. 9, the upstream valve 168 is closed at step S300 first, and ink is discharged at step S302. Next, the position (capacity) of the filter front chamber 184 is checked by determining the position of the upper housing 180 with the position determination sensor 104 (step S304). At this time, since the position of the upper housing 180 is already moved downward, the air bubbles can not be trapped because of the decrease of the air bubble trap region (i.e. the filter front chamber 184) even if the upper housing 180 is moved downward farther. In this case, i.e. in a disabled state (NG) in which the upper housing 180 cannot move farther downward, ink discharge is temporarily stopped after the process skips to S320, and the reset-mode 1 process is executed.

On the other hand, in an enabled (OK) state with favorable position determination results, air bubble determination is performed in the filter front chamber 184 by the air bubble determination sensor 176 at step S306. In the disabled state in which air bubbles are determined, the ink discharge is temporarily stopped after the process skips to step S330, and reset-mode 2 processes are executed.

In the enabled state in which air bubbles are not determined, the upper housing 180 is moved downward by the control device 165 and the capacity of the filter front chamber 184 is reduced (step S308). At this time, the ink pressure in vicinity of the print head 150 is determined by the pressure gauge 100, and the control device 165 controls the downward movement of the upper housing 180 on the basis of the determined ink pressure value that corresponds to the amount of ink discharged. By compressing the filter front chamber 184 in this manner, the ink is pressed so as to assist in the ink discharge. Therefore, it is possible to improve the ink discharge properties, particularly in the case of highly viscous ink.

Additionally, at this time, instead of the pressure gauge 100 determining the ink pressure in vicinity of the print head 150, the amount of ink discharged may be calculated from the print data. In this case, it is possible that the upper housing 180 is moved downward proportionally to the amount of ink discharge when the amount of ink discharged in one time period exceeds a specified threshold value.

Next, it is determined whether the print data is present (step S310). When the print data is still present, the ink is discharged after the process returns to step S302, and the print data is printed.

If there is no print data, the ink discharge is completed at step S312. After a specific amount of time has passed, reset-mode 1 is executed at step S320. After reset-mode 1, the process advances to step S314, the apparatus goes into standby mode, and the process is completed.

Figure 10:
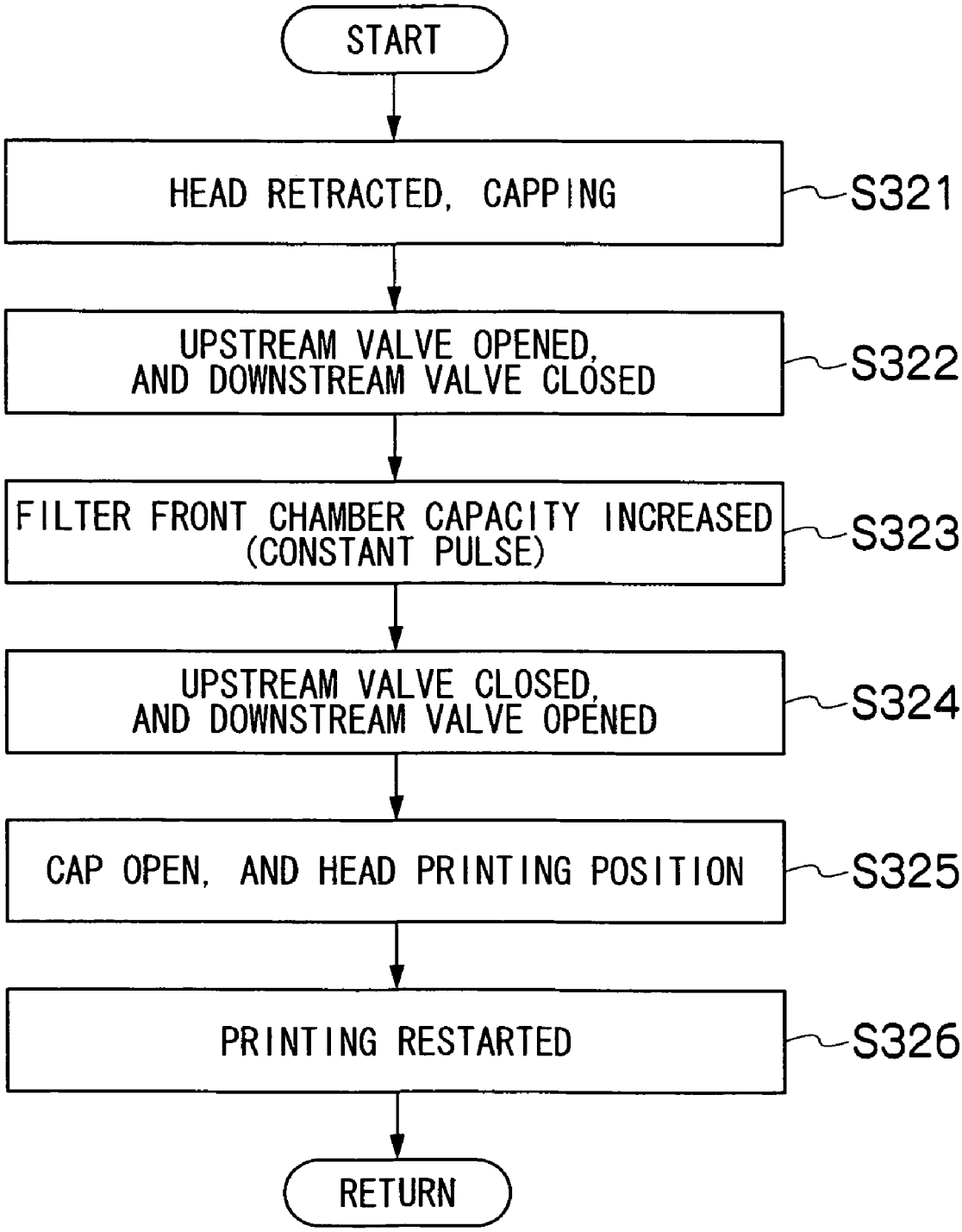
FIG. 10 is a flowchart showing the reset-mode 1 process in FIG. 9.

FIG. 10 is a flowchart showing the reset-mode 1 process in FIG. 9. In the reset-mode 1 shown in FIG. 10, first, the print head 150 is retracted and the cap 172 is applied to the print head 150 at step S321.

At step S322, the upstream valve 168 is opened and the downstream valve 170 is closed. Next, the upper housing 180 is moved upward by the control device 165 so as to increase the capacity of the filter front chamber 184 (step S323). At this time, the number of pulses which is counted from a pulse motor (not shown) may be used as the initial state for the movement distance. Otherwise, the housing may be returned to the position of the sensor by a separate start sensor composed additionally.

Next, at step S324, the upstream valve 168 is closed and the downstream valve 170 is opened. At step S325, the cap 172 applied to the print head 150 is opened and the print head 150 is moved to the printing position. Then, the printing is begun again at step S326. As described above, the reset-mode 1 process is constituted.

Figure 11:
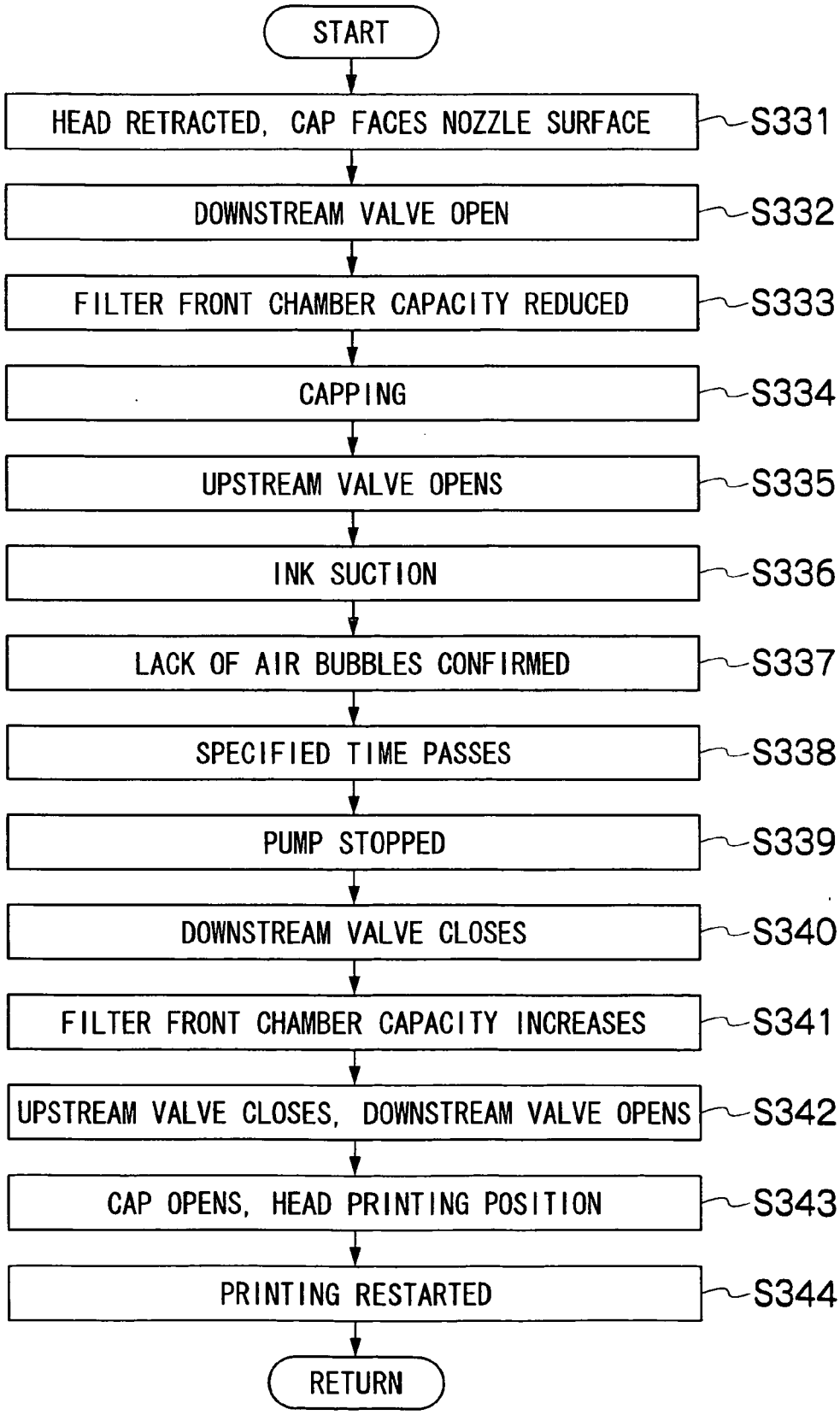
FIG. 11 is a flowchart showing the reset-mode 2 process in FIG. 9.

FIG. 11 is a flowchart showing the reset-mode 2 process in FIG. 9. As shown in FIG. 11, the reset-mode 2 is performed first to retract the print head 150 and to make the cap 172 face the nozzle surface of the print head 150 (step S331). Next, the downstream valve 170 is opened at step S332. Then, while the ink is pressurized by moving the upper housing 180 downward by the control device 165 so as to reduce the capacity of the filter front chamber 184, and the air bubble trap region is reduced in size so as to assist the air bubble expulsion resulting from the ink suction of the suction pump 174 (step S333).

Next, after the cap 172 is applied to the print head 150 at step S334, the upstream valve 168 is opened at step S335, and then ink containing air bubbles is suctioned out by the suction pump 174 at step S336. Next, the air bubble determination sensor 176 confirms whether or not air bubbles remain in the filter front chamber 184 at step S337. At this time, if air bubbles still remain, more ink containing air bubbles is suctioned out by the suction pump 174 to remove the remaining air bubbles.

Next, after the process waits until a specified amount of time has passed at step S338, the suction pump 174 is stopped being driven at step S339. Next, after the downstream valve 170 is closed at step S340, the upper housing 180 is moved upward by the control device 165 so as to increase the capacity of the filter front chamber 184 at step S341. Therefore, ink is filled into the filter unit 164.

Then, at step S342, the upstream valve 168 is closed and the downstream valve 170 is opened. After the cap 172 on the print head 150 is opened and the print head 150 moves to the printing position at step S343; the printing begins again at step S344. As the described above, the reset-mode 2 process is constituted.

Figure 12:
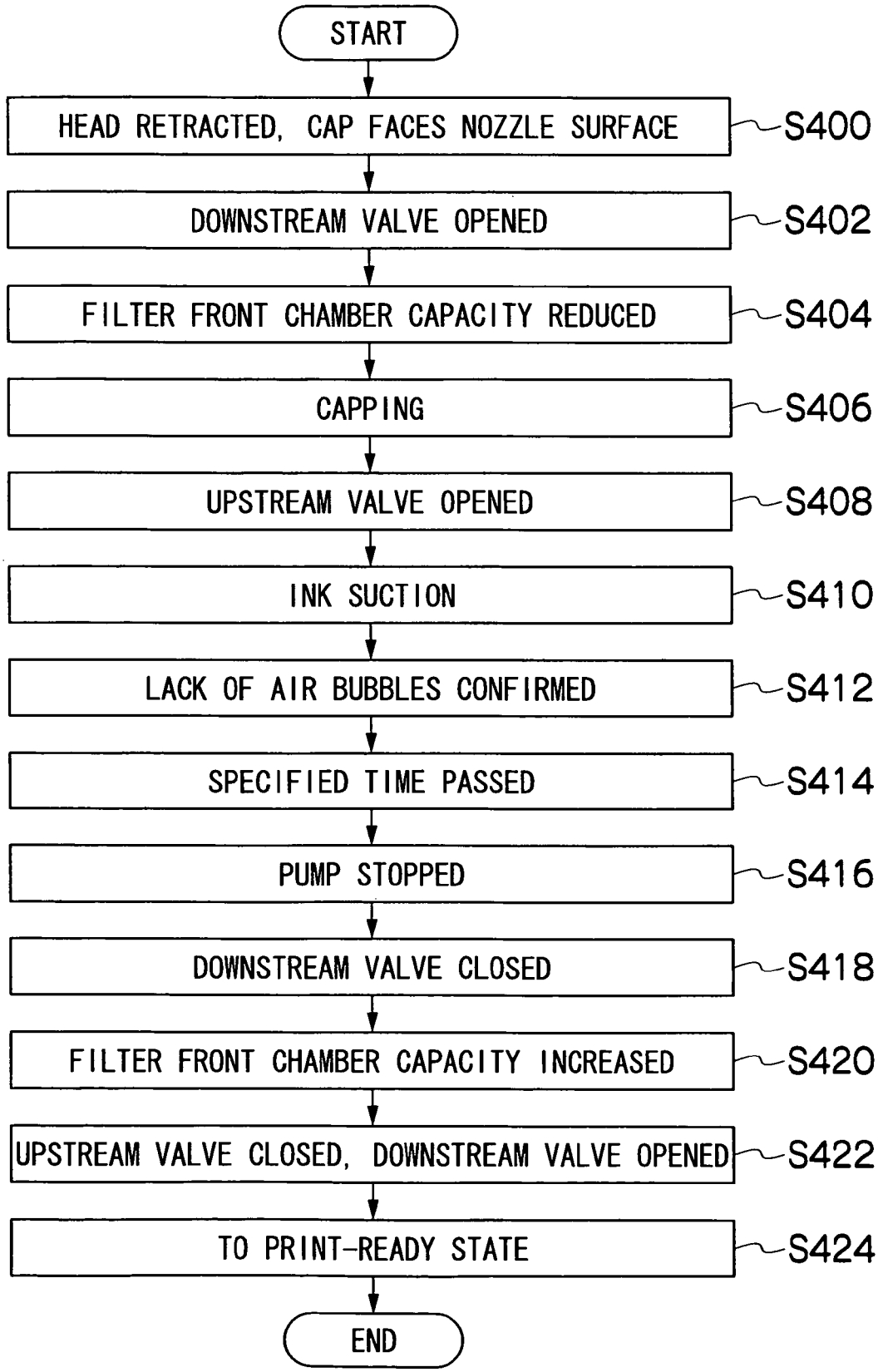
FIG. 12 is a flowchart showing the operation of discharging air bubbles in another embodiment.

Next, the process of air bubble expulsion in another embodiment is described. FIG. 12 is a flowchart showing the operation of discharging air bubbles in the another embodiment. The process up to step S422 in the flowchart in FIG.

12 is the same as the process from step S331 to step S342 in the flowchart in FIG. 11 previously described.

More specifically, first at step S400 in FIG. 12, the print head 150 is retracted and the cap 172 is faced the nozzle surface of the print head 150. Next, after the downstream valve 170 is opened at step S402, the ink is pressed by moving the upper housing 180 downward by the control device 165 so as to reduce the capacity of the filter front chamber 184, and then the air bubble trap region is reduced in size to assist the air bubble expulsion resulting from the ink suction of the suction pump 174 (step S404).

Next, after the cap 172 is applied to the print head 150 at step S406, the upstream valve 168 is opened at step S408, and then ink containing air bubbles is suctioned out by the suction pump 174 at step S410. Next, at step S412, the air bubble determination sensor 176 confirms whether or not air bubbles remain in the filter front chamber 184. At this time, if air bubbles is still remained, more ink containing air bubbles is suctioned out by the suction pump 174 so as to remove the remaining air bubbles.

After the process waits until a specified amount of time has passed at step S414, the suction pump 174 is stopped being driven at the next step S416. Next, after the downstream valve 170 is closed at step S418, the upper housing 180 is moved upward by the control device 165 so as to increase the capacity of the filter front chamber 184 at step S420. Therefore, ink is filled into the filter unit 164.

Then, after the upstream valve 168 is closed and the downstream valve 170 is opened at step S422, the process transfers to a print-ready state at step S424.

Thus, according to the present embodiment, since the pressure application on the ink is assisted by varying the capacity of the filter front chamber, it is possible to provide improvement in refilling the ink and discharging the ink. In addition, it is possible to improve the discharge properties, particularly for highly viscous ink.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus having an ink discharge head that discharges droplets of ink supplied from an ink tank via an ink supply channel, the apparatus comprising:
- a filter unit including,
  - a lower housing accommodating a filter which removes foreign matters from the ink to be supplied to the ink discharge head,
  - an upper housing adapted to slide with respect to the lower housing, such that the upper housing defines a filter front chamber with a variable capacity formed upstream from the filter in the filter units,
  - an ink inlet tube extending from the ink supply channel into the filter front chamber in a vertical direction, and
  - an air bubble trap region which accumulates air bubbles formed in the ink, the air bubble trap region being formed at top of the filter front chamber; and
- a control device which controls the variable capacity of the filter front chamber.

2. The inkjet recording apparatus as defined in claim 1, wherein the control device increases the capacity of the filter front chamber to enlarge the air bubble trap region during printing, and reduces the capacity of the filter front chamber during the air bubbles discharging.

3. The inkjet recording apparatus as defined in claim 1, wherein, during printing, the control device reduces the capacity of the filter front chamber in accordance with amount of discharged ink to pressurize the ink after increasing the capacity of the filter front chamber, so that ink supply to the ink discharge head and pressurization on the ink are assisted.

4. The inkjet recording apparatus as defined in claim 1, further comprising:
- a pressure gauge which measures pressure of the ink in the ink discharge head,
- wherein during printing, the control device reduces the capacity of the filter front chamber in accordance with pressure value measured by the pressure gauge to pressurize the ink after increasing the capacity of the filter front chamber, so that ink supply to the ink discharge head and pressurization on the ink are assisted.

5. The inkjet recording apparatus as defined in claim 1, further comprising:
- a pressure gauge which measures pressure of the ink in vicinity of the ink discharge head,
- wherein during printing, the control device reduces the capacity of the filter front chamber in accordance with pressure value measured by the pressure gauge to pressurize the ink after increasing the capacity of the filter front chamber, so that ink supply to the ink discharge head and pressurization on the ink are assisted.

6. The inkjet recording apparatus as defined in claim 1, wherein the air bubble trap region is formed in the filter front chamber by inserting the ink inlet tube which supplies the ink from the ink supply channel to the filter unit, up to interior of the filter front chamber.

7. The inkjet recording apparatus as defined in claim 1, further comprising:
- an air bubble determination device which determines the air bubbles in the air bubble trap region,
- wherein the air bubbles are discharged when amount of the air bubbles in the air bubble trap region reaches maximum amount of the air bubbles accumulable in the air bubble trap region.

8. The inkjet recording apparatus as defined in claim 7, wherein the air bubble determination device determines whether the air bubbles remain in the air bubble trap region after the air bubbles are discharged.

9. The inkjet recording apparatus as defined in claim 1, wherein an open end of the ink inlet tube is placed below the air bubble trap region.

10. The inkjet recording apparatus as defined in claim 1, further comprising:
- a first valve provided in the ink supply channel upstream of the filter unit and adapted to selectively open and close the ink supply channel; and
- a second valve provided in the ink supply channel downstream of the filter unit and adapted to selectively open and close the ink supply channel.

11. An inkjet recording apparatus having an ink discharge head that discharges droplets of ink supplied from an ink tank via an ink supply channel, the apparatus comprising:
- a filter unit including,
  - a filter which removes foreign matters, the filter unit being arranged in the ink supply channel,
  - a housing having a bellows side wall and defining a filter front chamber therein with a variable capacity formed upstream from the filter in the filter unit, and an air bubble trap region which accumulates air bubbles formed in the ink, the air bubble trap region being formed at top of the filter front chamber;

a control device which controls the variable capacity of the filter front chamber; and an air bubble determination device which determines the air bubbles in the air bubble trap region, wherein the air bubbles are discharged when amount of the air bubbles in the air bubble trap region reaches maximum amount of the air bubbles accumulable in the air bubble trap region, and the air bubble determination device determines whether the air bubbles remain in the air bubble trap region after the air bubbles are discharged.

12. An inkjet recording apparatus having an ink discharge head that discharges droplets of ink supplied from an ink tank via an ink supply channel, the apparatus comprising:

a filter unit including, a filter which removes foreign matters, the filter unit being arranged in the ink supply channel, a filter front chamber with a variable capacity formed upstream from the filter in the filter unit, an ink inlet tube extending from the ink supply channel into the filter front chamber in a vertical direction, and an air bubble trap region which accumulates air bubbles formed in the ink, the air bubble trap region being formed at top of the filter front chamber; and a control device which controls the variable capacity of the filter front chamber, wherein the filter unit includes, a cylindrical upper housing defining the filter front chamber, and a lower housing that supports the filter and adapted to move inside the cylindrical upper housing in the vertical direction to enlarge or reduce the size of the filter front chamber.

13. An inkjet recording apparatus having an ink discharge head that discharges droplets of ink supplied from an ink tank via an ink supply channel, the apparatus comprising:

a filter unit including, a filter which removes foreign matters, the filter unit being arranged in the ink supply channel, a filter front chamber with a variable capacity formed upstream from the filter in the filter unit, an ink inlet tube extending from the ink supply channel into the filter front chamber in a vertical direction, and an air bubble trap region which accumulates air bubbles formed in the ink, the air bubble trap region being formed at top of the filter front chamber; and a control device which controls the variable capacity of the filter front chamber, wherein the filter unit includes, a housing having a bellows side wall and defining the filter front chamber therein.

14. The inkjet recording apparatus as defined in claim 13, wherein the filter unit further includes means for driving said bellows side wall to change the size of the filter front chamber.

15. The inkjet recording apparatus as defined in claim 14, wherein said means for driving said bellows side wall includes an eccentric cam in contact with the housing, such that the size of the filter front chamber is changed by activating the eccentric cam.

* * * * *